US011905938B2

(12) United States Patent
Sassi et al.

(10) Patent No.: US 11,905,938 B2
(45) Date of Patent: Feb. 20, 2024

(54) PISTON HYDRAULIC DEVICE

(71) Applicant: Dana Motion Systems Italia S.R.L., Reggio Emilia (IT)

(72) Inventors: Alessandro Sassi, Reggio Emilia (IT); Fabio Natali, Modena (IT); Federica Franzoni, Reggio Emilia (IT)

(73) Assignee: DANA MOTION SYSTEMS ITALIA S.R.L., Reggio Emilia (IT)

( * ) Notice: Subject to any disclaimer, the term of this patent is extended or adjusted under 35 U.S.C. 154(b) by 690 days.

(21) Appl. No.: 17/047,951

(22) PCT Filed: Apr. 9, 2019

(86) PCT No.: PCT/EP2019/058906
§ 371 (c)(1),
(2) Date: Oct. 15, 2020

(87) PCT Pub. No.: WO2019/201665
PCT Pub. Date: Oct. 24, 2019

(65) Prior Publication Data

US 2021/0156369 A1 May 27, 2021

(30) Foreign Application Priority Data

Apr. 19, 2018 (EP) ..... 18425029

(51) Int. Cl.
*F04B 1/22* (2006.01)
*F04B 49/22* (2006.01)
*F04B 1/328* (2020.01)

(52) U.S. Cl.
CPC ..... *F04B 1/22* (2013.01); *F04B 1/328* (2013.01); *F04B 49/22* (2013.01)

(58) Field of Classification Search
CPC ..... F04B 1/2035; F04B 1/2042; F04B 1/22; F04B 1/30; F04B 49/03; F04B 49/22
See application file for complete search history.

(56) References Cited

U.S. PATENT DOCUMENTS 3,731,593 A * 5/1973 Chivari ..... F04B 1/2092 91/487
4,945,816 A * 8/1990 Mestieri ..... F01B 1/062 91/476

(Continued)

FOREIGN PATENT DOCUMENTS

CN 101403366 B * 6/2011
DE 10020453 A1 12/2000

(Continued)

OTHER PUBLICATIONS

CN101403366B_t machine translation thereof (Year: 2011).*

(Continued)

*Primary Examiner* — Kenneth Bomberg
*Assistant Examiner* — Matthew Wiblin
(74) *Attorney, Agent, or Firm* — McCoy Russell LLP

(57) ABSTRACT

A piston hydraulic device comprises a cylinder block having a plurality of cylinder assemblies and is rotatable about a first rotation axis. Each cylinder assembly comprises a cylinder and a piston. A port plate has a first port and a second port that are angularly spaced relative to the first rotation axis. A plurality of first conduits connect respective cylinders alternately to the first port or the second port. At least one second conduit is connected to a fluid reservoir. At least one directional control valve is positioned in the first conduit and fluidly connects to the second conduit. The at least one directional control valve connects the cylinder to the port plate in a first position and to the fluid reservoir in a second position. A controller is operatively associated with the directional control valve for switching between the first and the second positions.

15 Claims, 5 Drawing Sheets

(56) References Cited

U.S. PATENT DOCUMENTS

| | | | | |
|---|---|---|---|---|
| 5,941,156 | A * | 8/1999 | Nagatomo | F03C 1/0636 91/499 |
| 8,033,210 | B2 * | 10/2011 | Lemaire | F03C 1/045 91/519 |
| 9,074,578 | B2 * | 7/2015 | Souply | F03C 1/247 |
| 2003/0221550 | A1 * | 12/2003 | Achten | F01B 3/104 91/499 |
| 2011/0083553 | A1 * | 4/2011 | Duerr | F04B 1/328 92/5 R |

FOREIGN PATENT DOCUMENTS

| | | | |
|---|---|---|---|
| DE | 102007030749 | A1 | 1/2009 |
| DE | 102015206721 | A1 | 10/2016 |

OTHER PUBLICATIONS

ISA European Patent Office, International Search Report and Written Opinion Issued in Application No. PCT/EP2019/058906, dated May 29, 2019, WIPO, 10 pages.

* cited by examiner

PISTON HYDRAULIC DEVICE

CROSS-REFERENCE TO RELATED APPLICATIONS

The present application is a U.S. national phase of International Application No. PCT/EP2019/058906, entitled "PISTON HYDRAULIC DEVICE", and filed on Apr. 9, 2019. International Application No. PCT/EP2019/058906 claims priority to European Patent Application No. 18425029.8, entitled "PISTON HYDRAULIC DEVICE", and filed on Apr. 19, 2018.

TECHNICAL FIELD

This disclosure relates to the field of piston hydraulic devices such as pumps or motors, particularly to variable displacement piston hydraulic devices, and more particularly to the control of fluid displacement in the piston hydraulic devices.

BACKGROUND

Piston hydraulic devices may be axial piston machines or radial piston. The Piston hydraulic devices may be operated as pumps or motors.

Variable axial piston hydraulic devices may be swash plate type devices or bent axis type devices. Swash plate type axial piston devices have a tiltable swash plate that controls the stroke of the piston within a rotating cylinder block. With bent axis type axial piston devices, the pistons are at an angle to the drive shaft and thrust plate.

In both the "swash plate" and the "bent axis" types, the devices comprise a cylinder block carrying the pistons. The cylinder block rotates about a first axis. The devices also comprise a transmission shaft that rotates around a second axis of rotation, also called the transmission axis. Through this shaft mechanical work that is carried out for the compression of fluid (in the case of the pumps) or mechanical work (in the case of the motors) is determined by the pressure of the operating fluid.

In the swash plate type device, the first and second axes coincide. The swash plate has a variable inclination to vary the stroke of the pistons between the dead points and, accordingly, the displacement of the machine. For varying displacement in the swash plate type device, the inclination of the plate is varied to change the stroke of the pistons.

In bent-axis type device, the first and the second axis are incident. The relative inclination of these axes is varied to vary the stroke of the pistons between the dead points and, accordingly, the displacement of the machine. For varying displacement in the bent-axis type device, the inclination of the cylinder block is varied.

The present disclosure is directed, at least in part, to improving or overcoming one or more aspects of the prior art system.

SUMMARY

The present disclosure describes a piston hydraulic device. The device comprising a cylinder block having a plurality of cylinder assemblies. The cylinder block being rotatable about a first rotation axis wherein each cylinder assembly comprises a cylinder and a piston. A port plate having a first port and a second port, the first and second ports being angularly spaced relative to the first rotation axis. A plurality of first conduits for connecting respective cylinder alternately to the first port or the second port relative to the angular position of the cylinder assembly about the first rotation axis. At least one second conduit connected to a fluid reservoir. At least one directional control valve is positioned in the first conduit and fluidly connected to the second conduit wherein the at least one directional control valve connects the cylinder to the port plate in a first position and to the fluid reservoir in a second position. A controller operatively associated with the directional control valve for switching between the first and the second positions.

BRIEF DESCRIPTION OF THE FIGURES

The foregoing and other features and advantages of the present disclosure will be more fully understood from the following description of various embodiments, when read together with the accompanying drawings, in which.

DETAILED DESCRIPTION

This disclosure generally relates to a piston hydraulic device. The device is configured to have discrete variation of fluid displacement.

Figure 1:
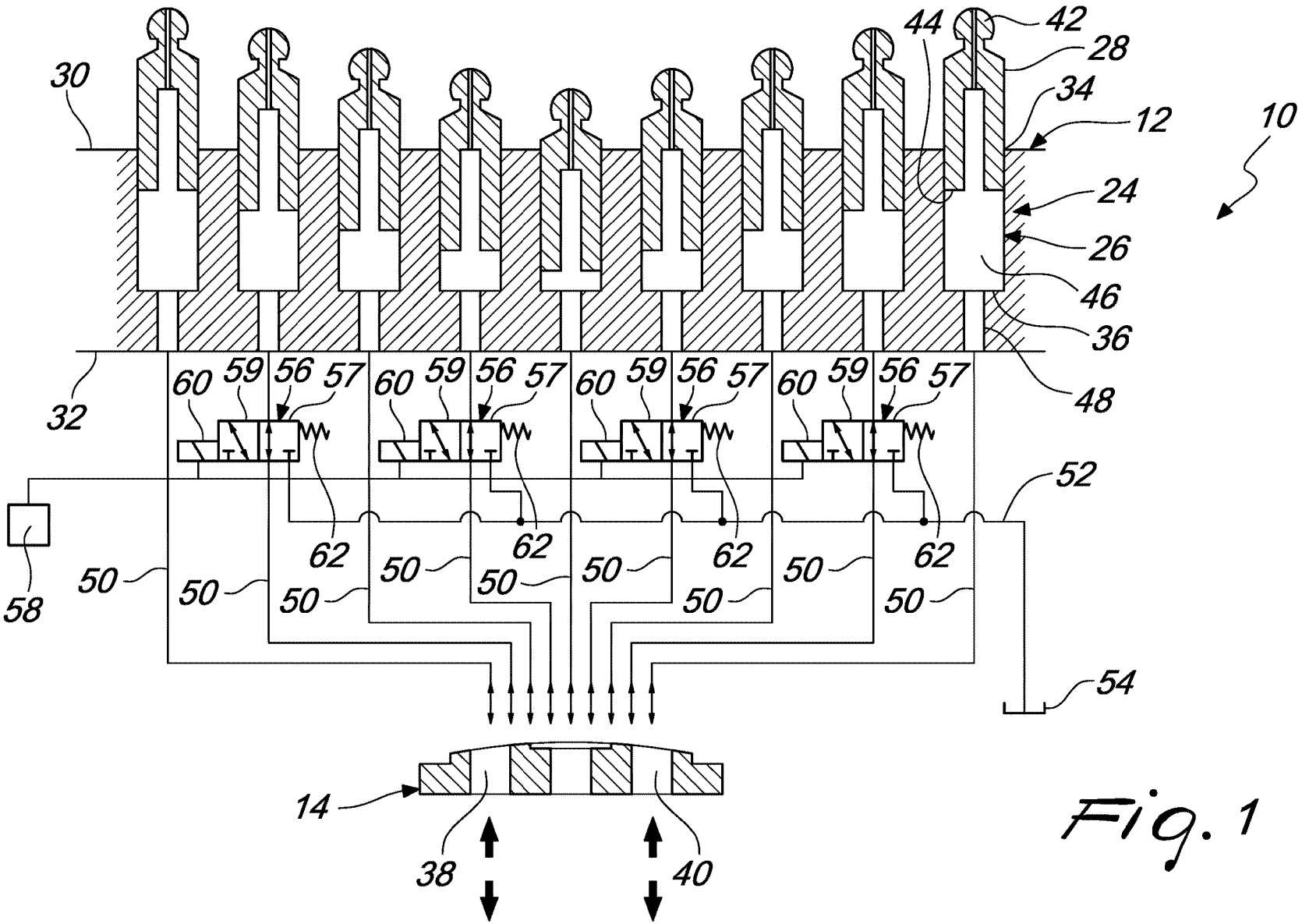
FIG. 1 is a schematic illustration of a piston hydraulic device in the first embodiment according to the present disclosure wherein the directional control valves are in the first position.

FIG. 1 schematically illustrates a piston hydraulic device 10 (hereinafter referred to as "device"). FIG. 1 illustrates an axial piston hydraulic device 10. In an alternative embodiment, the device 10 may be a radial piston hydraulic device. The device 10 comprises a cylinder block 12, a port plate 14, a plurality of first conduits 50, at least one second conduit 52, at least one directional control valve 56 and a controller 58.

The cylinder block 12 comprises a plurality of cylinder assemblies 24. The cylinder block 12 is rotatable about a first rotation axis A (not shown). The cylinder block 12 is rotatably supported in the device 10. Cylinder block 12 is rotatably supported in a housing (not shown) of the device 10. The cylinder assemblies 24 are radially positioned in the cylinder block 12 relative to the first rotation axis A. The cylinder assemblies 24 are mutually angularly spaced. The cylinder block 12 has first block surface 30 and a second block surface 32. First and second block faces 30, 32 are formed on opposite sides of the cylinder block 12. First and second block faces 30, 32 are parallel.

Each cylinder assembly 24 comprises a cylinder 26 and a piston 28. The cylinders 26 have respective openings 34 on the first block surface 30. Pistons 28 extend and retract in the cylinders 26. Pistons 28 extend from the openings 34. Cylinders 26 have a base 36. A cylinder conduit 48 extends from the base 36 to the second block face 32. Cylinder conduit 48 communicates with the cylinder 26. Fluid enters and exits the cylinder 26 through the cylinder conduit 48. Pistons 28 have a piston head 42 and a piston base 44. Piston head 42 is positioned external to the cylinder 26. Piston base 44 travels in the cylinder 26 during a stroke of the piston 28. Piston base 44 may move towards the base 36 of the cylinder 26 at the end of the return stroke. Each piston 28 moves along the respective cylinder 26 in parallel to the first rotation axis A.

Piston 28 defines a chamber 46 in the cylinder 26. The chamber 46 varies in volume as the piston 28 extends and retracts in the cylinder 26. Change in the fluid in the chamber 46 acts on the piston base 44. The chamber 46 varies in volume from a maximum volume which is reached when the piston 28 is at the top dead centre of an extraction stroke to a minimum volume which is reached when the piston 28 is at the bottom dead centre of a return stroke.

The port plate 14 has a first port 38 and a second port 40. Port plate 14 is supported in the housing (not shown) of the device 10. Port plate 14 is positioned adjacent the cylinder block 12. Port plate 14 is positioned so as to face the second block face 32. Cylinder block 12 is rotatable relative to the port plate 14. The first and second ports 38, 40 are angularly spaced relative to the first rotation axis A. The first and second ports 38, 40 are positioned in respective separate angular sectors. The cylinders 26 are configured to be alternately fluidly connected to the first and second ports 38, 40 as the cylinder block 12 rotates relative to the port plate 14. The cylinder conduit 48 of respective cylinders 26 fluidly alternately connects with the first and second ports 38, 40. The first and second ports 38, 40 are configured to be connected to different operating fluid sources. The fluid sources are a high pressure fluid source or a low pressure fluid source.

In an embodiment, the first and second ports 38, 40 respectively extend in arc about the first rotation axis A. First and second ports 38, 40 may be respectively formed as an elongated arc. In an alternate embodiment, first and second ports 38, 40 may be respectively formed as a series of holes of any shape. The series of holes may have an effect of an arc.

The plurality of first conduits 50 fluidly connect respective cylinders 26 to the port plate 14. The plurality of first conduits 50 fluidly connect respective cylinder conduits 48 to the port plate 14. The plurality of first conduits 50 fluidly connect respective cylinder conduits 48 to the port plate 14 relative to the angular position of the cylinder assembly 24 about the first rotation axis A. Each cylinder 26 connects to the first and second ports 38, 40 of the port plate 14 as the cylinder block 12 rotates about the first rotation axis A.

The plurality of first conduits 50 alternately fluidly connects respective cylinder 26 to the first port 38 or the second port 40. The plurality of first conduits 50 alternately fluidly connects respective cylinder conduits 48 to the first port 38 or the second port 40. The plurality of first conduits 50 alternately fluidly connects respective cylinder conduits 48 to the first port 38 or the second port 40 relative to the angular position of the cylinder assembly 24 about the first rotation axis A. Each cylinder 26 alternately connects to the first port 38 or the second port 40 of the port plate 14 as the cylinder block 12 rotates about the first rotation axis A.

The first conduit 50 is formed as an annular channel in cross section. The first conduit 50 is formed in the housing (not shown) of the device 10. Each first conduit 50 is distinct. Each cylinder 26 connects to the port plate 14 separately through the respective first conduit 50.

The at least one second conduit 52 connects to a fluid reservoir 54. The second conduit 52 is formed as an annular channel in cross section. The second conduit 52 is formed in the housing (not shown) of the device 10. In an embodiment, a single second conduit 52 connects to the fluid reservoir 54. In a further embodiment, a plurality of second conduits 52 connect to the fluid reservoir 54. In an embodiment, the fluid reservoir 54 is a tank. In an alternate embodiment, the fluid reservoir 54 is an accumulator. In FIG. 1, the fluid reservoir is a tank 54.

The at least one directional control valve 56 is fluidly connected to the respective cylinder assembly 24. In a preferred embodiment, the at least one directional control valve 56 is fluidly connected to the respective cylinder 26. In yet a preferred embodiment, the at least one directional control valve 56 is fluidly connected to the respective cylinder 26 through the cylinder conduit 48.

The at least one directional control valve 56 is fluidly connected to the respective first conduit 50. The at least one directional control valve 56 is interposed between the cylinder 26 and the port plate 14 relative to the first conduit 50. In an embodiment, the at least one directional control valve 56 is fluidly connected to the respective cylinder 26 through first conduit 50. The at least one directional control valve 56 is positioned in the first conduit 50.

The at least one directional control valve 56 is fluidly connected to the second conduit 52. The at least one directional control valve 56 is interposed between the cylinder 26 and fluid reservoir 54 relative to the second conduit 52. In an embodiment, the fluid reservoir 54 is fluidly connected to the respective cylinder 26 through the at least one directional control valve 56 and the first conduit 50. In an embodiment, the fluid reservoir 54 is fluidly connected to the respective cylinder 26 through the at least one directional control valve 56 and a part of the first conduit 50.

In an embodiment, the device 10 has a plurality of directional control valves 56. Each directional control valve 56 is connected to a respective cylinder 26. Each directional control valve 56 is connected to a respective first conduit 50. Each directional control valve 56 is connected to the second conduit 52. The plurality of at least one directional control valves 56 are each actuatable independently.

The cylinders 26 in the cylinder block 12 are each connected to a respective directional control valve 56. The cylinders 26 in the cylinder block 12 are each connected to a respective first conduit 50 through the at least one directional control valve 56. The cylinders 26 in the cylinder block 12 are each connected to the second conduit 52 through the at least one directional control valve 56.

In a further embodiment, a portion of the total number of cylinders 26 in the cylinder block 12 are connected to a respective directional control valve 56. The number of cylinders 26 that are connected to the a directional control valve 56 may be predetermined. A portion of the of the total number of cylinders 26 in the cylinder block 12 are connected directly to a respective first conduit 50. The cylinders 26 that are connected directly to the respective first conduit 50 are not connected to a directional control valve 56.

The at least one directional valve 56 is actuatable between a first position 57 and a second position 59. The at least one directional valve 56 is actuatable between a first position 57 and a second position 59 through mechanical means. The mechanical means is electronically controlled. In an embodiment, the mechanical means is an actuation member 60. Actuation member 60 may be comprised in the at least one directional valve 56.

In a further embodiment, the actuation member 60 may operate in conjunction with a return spring 62. The activation of the actuation member 60 may actuate the at least one directional valve 56 from the first position 57 to the second position 59. The deactivation of the actuation member 60 permits the return spring 62 to return the at least one direction valve 56 from the second position 59 to the first position 57. In an embodiment, the directional control valve 56 is a three way two position valve.

The at least one directional control valve 56 connects the cylinder 26 to the port plate 14 in the first position 57. In the first position 57 of the at least one directional control valve 56, the cylinder 26 alternately connects to the first port 38 or the second port 40 as the cylinder block 12 rotates about the first rotation axis A. The piston 28 extends or retracts corresponding to the fluid flow between the chamber 46 and either the first port 38 or the second port 40. The piston 28 extends or retracts correspondingly in regards to the pressure differential between the chamber 46 and either the first port 38 or the second port 40.

The at least one directional control valve 56 connects the cylinder 26 to the fluid reservoir 54 in the second position 59. In the second position 59 of the at least one directional control valve 56, the cylinder 26 is not connected to the first port 38 or the second port 40 as the cylinder block 12 rotates about the first rotation axis A. Fluid flows to and from the chamber 46 to the fluid reservoir 54. Fluid in the fluid reservoir 54 is not pressurised. Piston 28 is not subjected to a fluid pressure so as to extend from the cylinder 26.

The controller 58 is operatively associated with the at least one directional control valve 56 for switching between the first and the second positions 57, 59. Controller 58 electronically sends signals to the actuation member 60 for actuation of the at least one directional control valve 56 between the first and the second positions 57, 59. In embodiment, controller 58 electronically sends signals to the actuation member 60 for actuation of the at least one directional control valve 56 from the first position 57 to the second position 59. Controller 58 comprises a programmable memory module. The memory module is programmable for the actuation of the at least one directional control valve 56. The timing and operation of the actuation may be performed in accordance to the programmable memory.

In an embodiment, a controller 58 is connected to the at least one directional control valve 56. In a further embodiment, a controller 58 is connected to a plurality of at least one directional control valves 56. In yet a further embodiment, a plurality of controllers 58 are connected to each at least one directional control valve 56.

Figure 2:
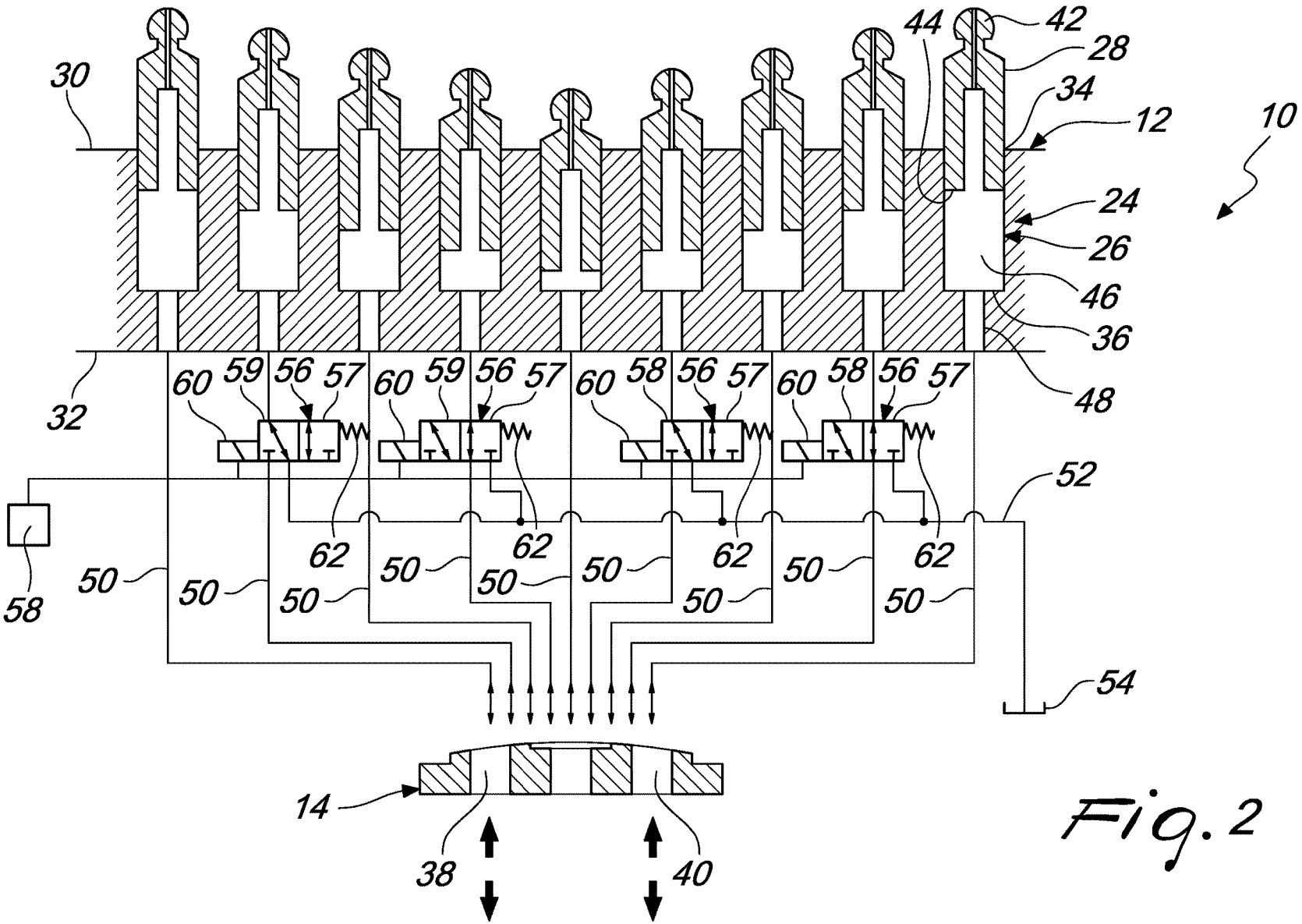
FIG. 2 is a schematic illustration of the piston hydraulic device of FIG. 1 wherein a first set of directional control valves are in the first position and a second set of directional control valves are in the second position.

With reference to FIG. 2, the device 10, in the first embodiment, comprises a cylinder block 12 having cylinder assemblies 24 of which a portion of the cylinders 26 are connected to a directional control valve 56. Four cylinders 26 are connected to respective directional control valves 56 so that the respective cylinders assemblies 24 are under the control of the controller 58. The fluid connection alternates between the port plate 14 and the fluid reservoir 54. Two cylinders 26 are fluidly connected to the fluid reservoir 54 through the second conduit 52, with the respective directional control valves 56 in the second position 59. Two cylinders 26 are fluidly connected to the port plate 14 through the first conduit 50, with the respective directional control valves 56 in the first position.

Figure 3:
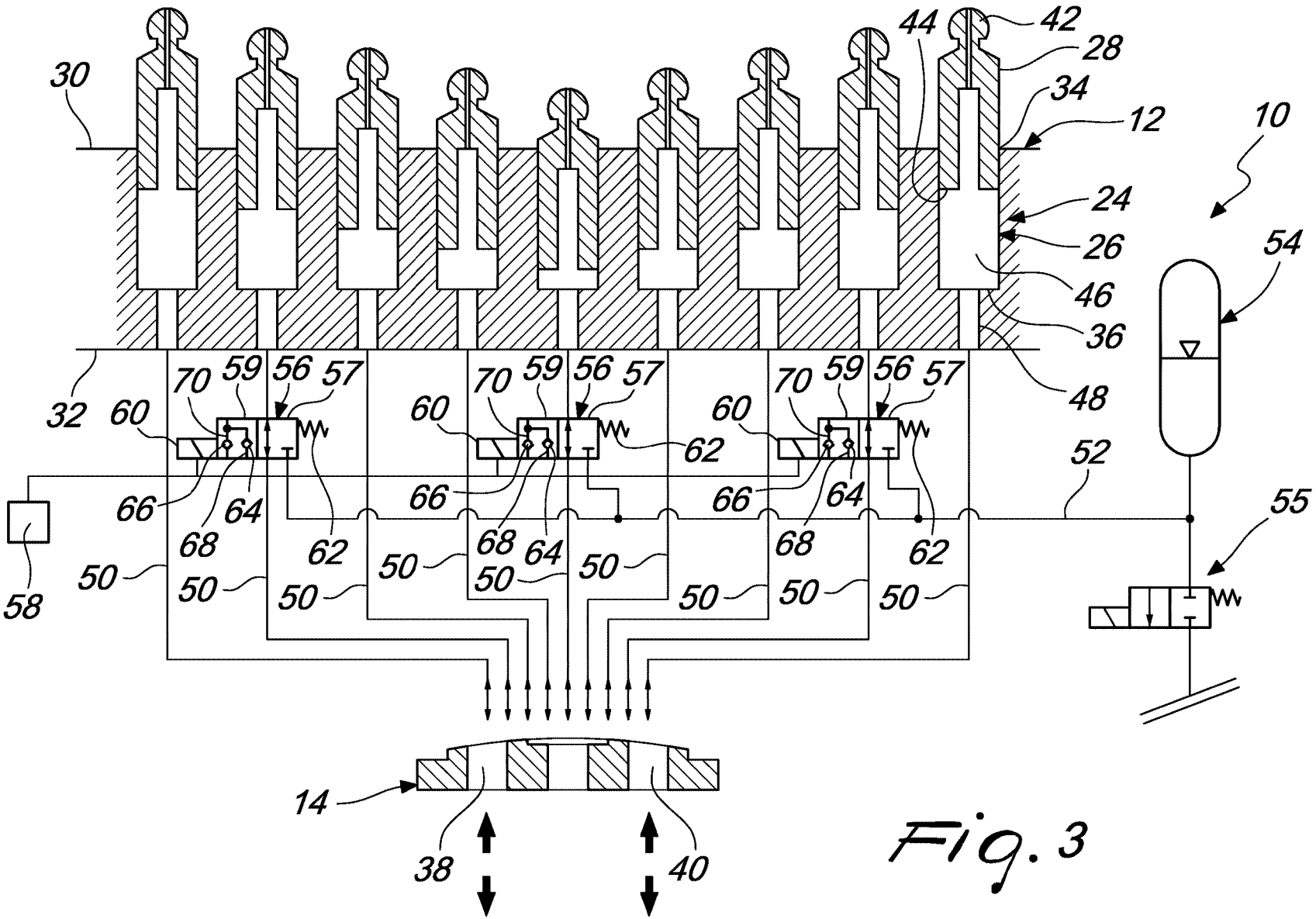
FIG. 3 is a schematic illustration of the piston hydraulic device in the second embodiment wherein the directional control valves are in the first position.

FIG. 3 illustrates the device 10 in the second embodiment. The specific features with respect to the second embodiment will now be described. The fluid reservoir 54 is an accumulator 54. The at least one second conduit 52 connects to the accumulator 54. The accumulator 54 is further connected to a secondary work circuit (not shown) through a valve 55. Valve 55 may be actuated to establish a fluid connection between the accumulator and the secondary work circuit.

In the second position 59, the at least one directional valve 56 connects the cylinder 26 to the second conduit 52 and to the respective first conduit 50. The at least one directional control valve 56 connects the cylinder 26 to the port plate 14 and the accumulator 54 in the second position 59.

A first check valve 64 is integrated in the at least one directional valve 56. The first check valve 64 is interposed in the connection between the cylinder 26 and the accumulator 54. The first check valve 64 is positioned in a first diversion line 68 connection between the cylinder 26 and the accumulator 54. The first check valve 64 is configured to permit flow from the cylinder 26 to the accumulator 54. The first check valve 64 is configured to obstruct flow from the accumulator 54 to the cylinder 26.

A second check valve 66 is integrated in the at least one directional valve 56. The second check valve 66 is interposed in the connection between the cylinder 26 and the port plate 14. The second check valve 66 is positioned in a second diversion line 70 for the connection between the cylinder 26 and the port plate 14. The second check valve 66 is configured to obstruct flow from the cylinder 26 to the port plate 14. The first check valve 64 is configured to permit flow from the port plate 14 to the cylinder 26.

In the second position 59 of the at least one directional control valve 56, the cylinder 26 is connected to the first port 38 or the second port 40 as the cylinder block 12 rotates about the first rotation axis A. Cylinder 26 is connected to the first port 38 or the second port 40 through the second diversion line 70. The cylinder 26 is connected to the accumulator 54. Cylinder 26 is connected to the accumulator 54 through the first diversion line 68.

In respect to the device 10 acting as a motor, with the piston 28 retracted in the cylinder 26 the connection to a port 38, 40 with the high pressure fluid permits pressurised fluid to flow to the chamber 46 so as to extract the piston 28. Fluid is permitted to flow through the second check valve 66. Fluid flows though second diversion line 70. Fluid from the accumulator 54 is obstructed from flowing to the cylinder 26 by the first check valve 64.

With the piston 28 extracted in the cylinder 26 the connection to a port 38, 40 with the low pressure fluid, fluid flows from the cylinder 26 for the retraction of the piston 28. Second check valve 66 obstructs fluid from flowing to the port plate 14. Fluid is permitted to flow through the first check valve 64 to the accumulator 54. Fluid flows though first diversion line 68.

In respect to the device 10 acting as a pump, with the piston 28 retracted in the cylinder 26 the connection to a port 38, 40 with the low pressure fluid permits pressurised fluid to flow to the chamber 46. The piston 28 is extracts from the cylinder 26. Fluid is permitted to flow through the second check valve 66. Fluid flows though second diversion line 70. Fluid from the accumulator 54 is obstructed from flowing to the cylinder 26 by the first check valve 64.

With the piston 28 extracted in the cylinder 26 the connection to a port 38, 40 with the high pressure fluid, fluid flows from the cylinder 26. The piston 28 retracts into the cylinder 26. Second check valve 66 obstructs fluid from flowing to the port plate 14. Fluid is permitted to flow through the first check valve 64 to the accumulator 54. Fluid flows though first diversion line 68.

Figure 4:
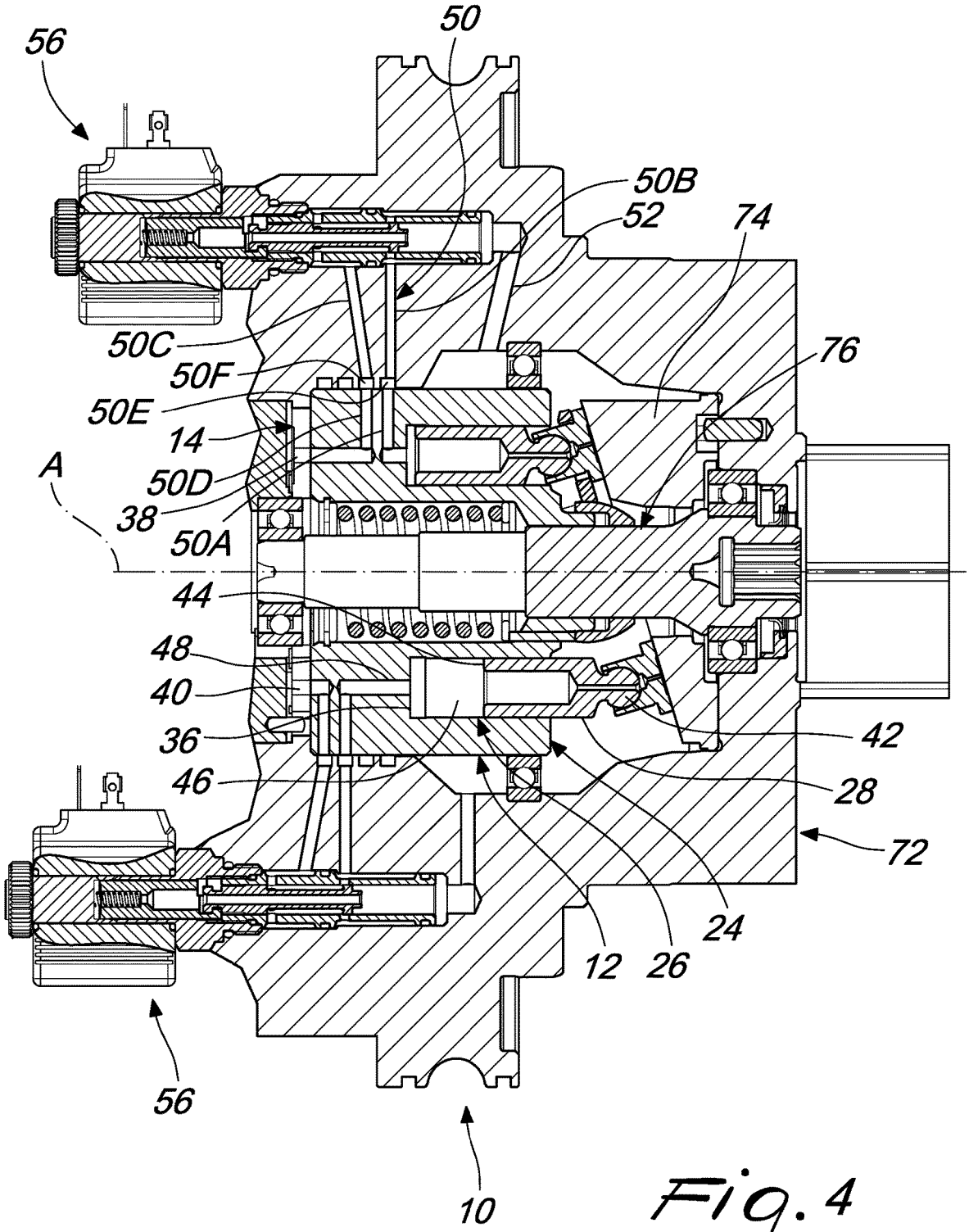
FIG. 4 is a cross sectional view of a portion of a swash plate type axial piston hydraulic device according to the present disclosure.

FIG. 4 illustrates the device 10 as a swash plate type axial piston hydraulic device. Device 10 comprises a housing 72.

A shaft 76 is coupled to the cylinder block 12. In an embodiment, shaft 76 may be a drive shaft. In an alternative embodiment, shaft 76 may be a driven shaft. In a further embodiment, shaft 76 may be coupled to a drive shaft. In an alternative further embodiment, shaft 76 may be coupled to a driven shaft. The shaft 76 is rotatably supported by the housing 72 around the first rotation axis A. A swash plate 74 is coupled to the housing 72. The shaft 76 is inserted passing through the swash plate 74. The swash plate 74 has ring conformation. The port plate 14 is coupled to the housing 72. In an embodiment, the at least one directional control valve 56 is coupled to the housing 72. In a further embodiment, a plurality of directional control valves 56 are coupled to the housing 72. The cylinder block 12 is rotatably supported in the housing 72. Pistons 28 are movably positioned in the respective cylinders 26. Pistons 28 are coupled to the swash plate 74. Cylinder conduits 48 extend from the base 36 of respective cylinders 26.

The first conduit 50 extends from the cylinder block 12 through the housing 72. A portion of the first conduit 50 extends through the cylinder block 12. First conduit 50 extends from the respective cylinder conduit 48 through the cylinder block 12. A first conduit path 50A of the first conduit 50 extends through the cylinder block 12 to the housing 72. The first conduit 50 extends to the at least one directional valve 56. A second conduit path 50B extends through the housing 72 to the at least one directional valve 56. A first annular groove 50E is interposed between the first and second conduit path 50A and 50B. The first annular groove 50E is defined in the housing 72.

The first conduit 50 extends from the at least one directional valve 56 back to the cylinder block 12. A third conduit path 50C extends through the housing 72 to the cylinder block 12. The first conduit 50 extends through the cylinder block 12 to the port plate 14. A fourth conduit path 50D extends through the cylinder block 12 to the port plate 14. A second annular groove 50F is interposed between the third and fourth conduit path 50C and 50D. The second annular groove 50F defined in the housing 72.

Sealing gaskets (not shown) are interposed between the first and second annular groove 50E and 50F, the housing 72 and the cylinder block 12.

The second conduit 52 extends through the housing 72. The second conduit 52 extends through the housing 72 to the fluid reservoir 54 (not shown).

Figure 5:
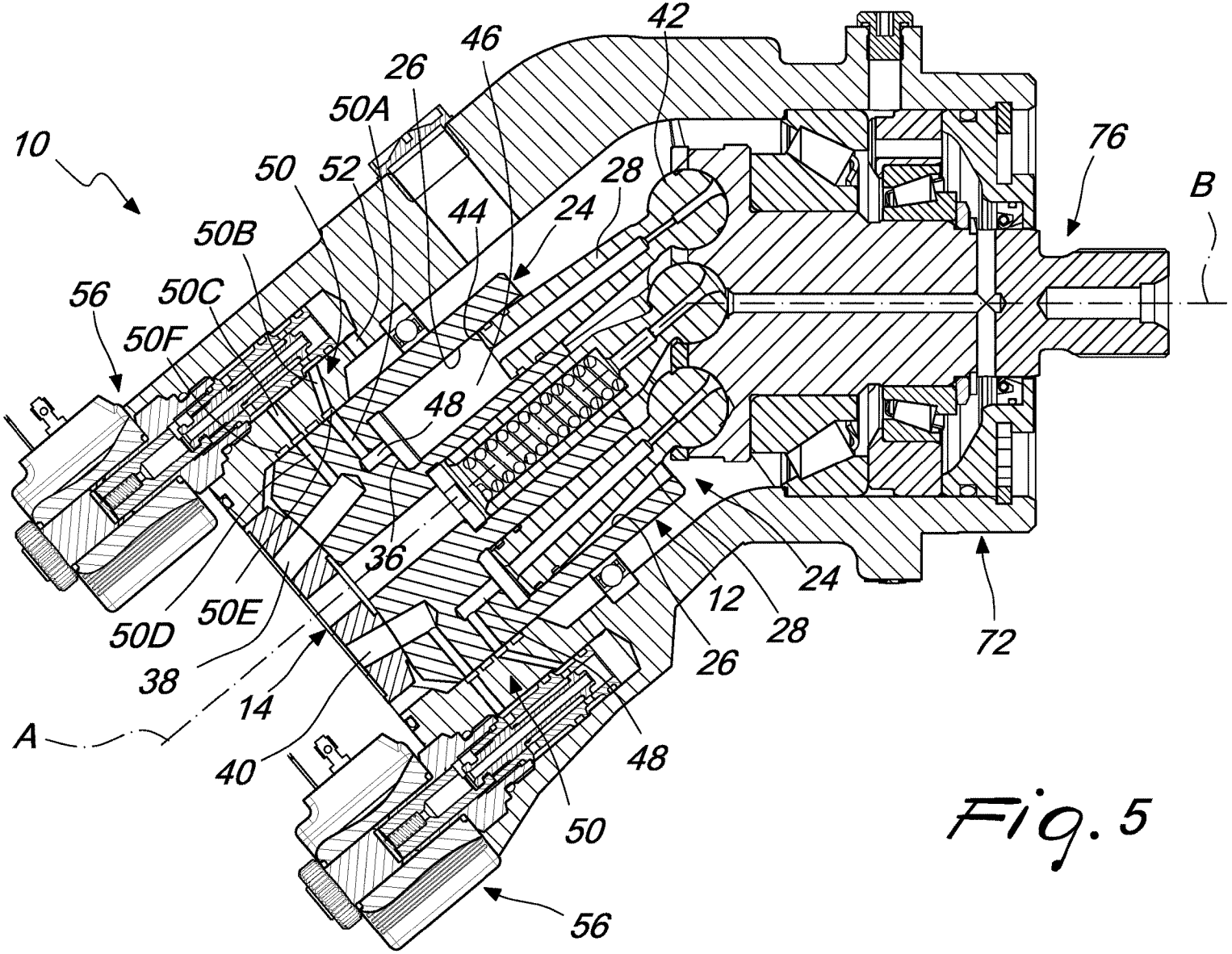
FIG. 5 is a cross sectional view of a portion of a bent axis type axial piston hydraulic device according to the present disclosure.

FIG. 5 illustrates the device 10 as a bent-axis type axial piston hydraulic device. Device 10 comprises a housing 72. A shaft 76 is coupled to the housing 72. In an embodiment, shaft 76 may be a drive shaft. In an alternative embodiment, shaft 76 may be a driven shaft. In a further embodiment, shaft 76 may be coupled to a drive shaft. In an alternative further embodiment, shaft 76 may be coupled to a driven shaft. The shaft 76 is rotatably supported by the housing 72 around a second rotation axis B inclined in respect of the first rotation axis A. The port plate 14 is coupled to the housing 72. In an embodiment, the at least one directional control valve 56 is coupled to the housing 72. In a further embodiment, a plurality of directional control valves 56 are coupled to the housing 72. The cylinder block 12 is rotatably supported in the housing 72. Pistons 28 are movably positioned in the respective cylinders 26. Pistons 28 are coupled to the shaft 76. Cylinder conduits 48 extend from the base 36 of respective cylinders 26.

The first conduit 50 extends from the cylinder block 12 through the housing 72. A portion of the first conduit 50 extends through the cylinder block 12. First conduit 50 extends from the respective cylinder conduit 48 through the cylinder block 12. A first conduit path 50A of the first conduit 50 extends through the cylinder block 12 to the housing 72. The first conduit 50 extends to the at least one directional valve 56. A second conduit path 50B extends through the housing 72 to the at least one directional valve 56. A first annular groove 50E is interposed between the first and second conduit path 50A and 50B. The first annular groove 50E is defined in the housing 72.

The first conduit 50 extends from the at least one directional valve 56 back to the cylinder block 12. A third conduit path 50C extends through the housing 72 to the cylinder block 12. The first conduit 50 extends through the cylinder block 12 to the port plate 14. A fourth conduit path 50D extends through the cylinder block 12 to the port plate 14. A second annular groove 50F is interposed between the third and fourth conduit path 50C and 50D. The second annular groove 50F defined in the housing 72.

Sealing gaskets (not shown) are interposed between the first and second annular groove 50E and 50F, the housing 72 and the cylinder block 12.

The second conduit 52 extends through the housing 72. The second conduit 52 extends through the housing 72 to the fluid reservoir 54 (not shown).

In an embodiment, the device 10 is configured to operate as a hydraulic motor. In an alternate embodiment, the device 10 is configured to operate as a pump.

The skilled person would appreciate that foregoing embodiments may be modified or combined to obtain the axial piston hydraulic device 10 of the present disclosure.

This disclosure describes an axial piston hydraulic device 10 that has individually variable pistons. The axial piston hydraulic device 10 provides for the discrete variation in fluid displacement. The discrete variation of displacement is enabled without modifying the geometric configuration axial piston hydraulic device 10. The relative inclination of the various structures are not varied to obtain the same objectives. The relative inclination of the various structures such as the swash plate or the housing, are not varied to obtain the same objectives.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein.

Where technical features mentioned in any claim are followed by reference signs, the reference signs have been included for the sole purpose of increasing the intelligibility of the claims and accordingly, neither the reference signs nor their absence have any limiting effect on the technical features as described above or on the scope of any claim elements.

One skilled in the art will realise the disclosure may be embodied in other specific forms without departing from the disclosure or essential characteristics thereof. The foregoing embodiments are therefore to be considered in all respects illustrative rather than limiting of the disclosure described herein. Scope of the invention is thus indicated by the appended claims, rather than the foregoing description, and all changes that come within the meaning and range of equivalence of the claims are therefore intended to be embraced therein.

The disclosures in European Patent Application No. 18425029.8 from which this application claims priority are incorporated herein by reference.

The invention claimed is:

1. A piston hydraulic device, comprising:

a cylinder block having a plurality of cylinder assemblies, the cylinder block being rotatable about a first rotation axis wherein each cylinder assembly comprises a cylinder and a piston;

a port plate having a first port and a second port, the first and second ports being angularly spaced relative to the first rotation axis; and a plurality of first conduits for connecting respective cylinder alternately to the first port or the second port relative to an angular position of the cylinder assembly about the first rotation axis, wherein, the axial piston hydraulic device further comprises:

at least one second conduit connected to a fluid reservoir;

at least one directional control valve positioned in at least one of the first conduits and fluidly connected to the second conduit wherein the at least one directional control valve connects the cylinder to the port plate in a first position and to the fluid reservoir in a second position; wherein a portion of a total number of cylinders in the cylinder block is connected directly to a respective first conduit and wherein the cylinders that are connected directly to the respective first conduit are not connected to a directional control valve of a plurality of directional control valves including the at least one directional control valve; and a controller operatively associated with the directional control valve for switching between the first and the second positions.

2. The piston hydraulic device of claim 1, wherein the at least one directional control valve connects the cylinder to the first port or the second port in the first position.

3. The piston hydraulic device of claim 1, wherein the fluid reservoir is a tank.

4. The piston hydraulic device of claim 1, wherein the fluid reservoir is an accumulator.

5. The piston hydraulic device of claim 4, wherein the at least one directional control valve connects the cylinder to the port plate and the accumulator in the second position.

6. The piston hydraulic device of claim 5, wherein a first check valve is integrated in the directional control valve, the first check valve being interposed between the cylinder and the accumulator wherein the first check valve is configured to obstruct fluid flow from the accumulator to the cylinder.

7. The piston hydraulic device of claim 5, wherein a second check valve is integrated in the directional control valve, the second check valve being interposed between the cylinder and the port plate wherein the second check valve is configured to obstruct fluid flow from the cylinder to the port plate.

8. The piston hydraulic device of claim 1, wherein the device is a bent axis hydraulic device.

9. The piston hydraulic device of claim 1, wherein the device is a swash plate type hydraulic device.

10. The piston hydraulic device of claim 1, further comprising a housing wherein the at least one directional control valve is coupled to the housing.

11. The piston hydraulic device of claim 1, wherein the at least one of the first conduits extends from the cylinder block through the housing.

12. The piston hydraulic device of claim 1, wherein the second conduit extends through the housing.

13. The piston hydraulic device of claim 1, wherein the device is an axial piston hydraulic device.

14. The piston hydraulic device of claim 1, wherein the at least one directional control valve is interposed between the cylinder and the port plate relative to the at least one of the first conduits.

15. The piston hydraulic device of claim 1, wherein a portion of a total number of cylinders in the cylinder block are connected to a respective directional control valve.

* * * * *